United States Patent [19]

Kraska

[11] 4,448,322

[45] May 15, 1984

[54] METAL CONTAINER END

[75] Inventor: John L. Kraska, Riverside, Ill.

[73] Assignee: National Can Corporation, Chicago, Ill.

[21] Appl. No.: 83,870

[22] Filed: Oct. 11, 1979

Related U.S. Application Data

[60] Division of Ser. No. 968,099, Dec. 8, 1978, Pat. No. 4,217,843, which is a continuation-in-part of Ser. No. 820,237, Jul. 29, 1977, abandoned.

[51] Int. Cl.[3] ..... B65D 8/08

[52] U.S. Cl. ..... 220/67; 220/66

[58] Field of Search ..... 220/66, 67; 113/121 C

[56] References Cited

U.S. PATENT DOCUMENTS

| | | | |
|---|---|---|---|
| 3,441,170 | 4/1969 | Khoury | 220/66 X |
| 3,843,014 | 10/1974 | Cospen et al. | 220/66 |
| 4,031,837 | 6/1977 | Jordan | 113/121 C |

*Primary Examiner*—Allan N. Shoap

*Attorney, Agent, or Firm*—Robert A. Stenzel; Ralph R. Rath

[57] ABSTRACT

A container end formed from metal having an approximate thickness of 0.0120 inches which is capable of withstanding at least 90 psi buckle pressure and at least 60 psi rock pressure is disclosed herein. A container end panel includes a peripheral curl surrounding a substantially flat center panel with a countersink therebetween. The countersink has inner and outer substantially flat walls that are interconnected by an arcuate portion that has a radius of approximately 0.030 inches and the inner wall is connected to the periphery of the center panel through an arcuate portion that has a radius of approximately 0.025 inches. The outer flat wall has a length which is greater than the length of the inner flat wall and the outer flat wall defines an angle of less than five degrees with respect to a plane that extends perpendicular through the center flat panel. The inner flat wall has a length to locate the lower edge of the countersink about 0.075 inches or more below the lower edge of the periphery of the center panel and defines a minimum angle with respect to a vertical reference plane.

5 Claims, 3 Drawing Figures

METAL CONTAINER END

This application is a Divisional application of Ser. No. 968,099, filed Dec. 8, 1978, now U.S. Pat. No. 4,217,843, which in turn is a Continuation-In-Part application of Ser. No. 820,237, filed July 29, 1977, now abandoned.

BACKGROUND OF THE INVENTION

The present invention relates generally to container end panels and more particularly to panels that are utilized in conjunction with containers that are used for packaging products under high pressure, such as beer and/or carbonated beverages.

In recent years, many of these products have commonly been packaged in metal containers formed either of aluminum or tinplated steel. Since the beer and carbonated beverage industry utilizes at least 46 billion containers annually in the United States, it is essential that the containers be formed of a minimum thickness of metal so that the container can be marketed at a competitive price. The cost of the container is extremely important since, for many products, the cost of the container approaches or exceeds the cost of the product being packaged therein. As such, any cost reduction in manufacturing finished containers is extremely desirable.

Because of the large market for metal containers, particularly those formed of aluminim, a very small savings in the amount of material for a single container can substantially effect the overall cost considerations. For example, a reduction in metal thickness of approximately 0.001 inches can result in millions of dollars in savings for a manufacturer of cans.

In recent years, many beverages have been packaged in what is commonly referred to as a two-piece container. In this container, the bottom wall and sidewall are formed as an integral unit by drawing and ironing a flat blank to produce a container body open at one end. The open end of the body then has an end panel secured thereto by a conventional seaming process.

When these types of containers are utilized for packaging beer and/or carbonated beverages, the containers must be capable of withstanding minimum pressures of 90 psi before the container end will "buckle" and also be capable of withstanding minimum pressures of 60 psi before the container will "rock". The term "rock" is related to the deflection of the center panel portion of the end panel, which normally has a tab connected thereto by a rivet, and the term identifies the pressure at which any given portion of the center of the end panel projects above the upper peripheral edge or chime of the container. The term "buckle" pressure is the pressure that an end is capable of withstanding without any notable distortion of the end and/or rupture of any portion of the end.

Quite recently the assignee of the present invention developed a drawn and ironed container that can be manufactured with a minimum amount of metal and still be capable of withstanding the pressures indicated above. This drawn and ironed container is disclosed in U.S. Pat. No. 3,942,673 issued to Seung W. Lyu et al. While this drawn and ironed container has found a remarkable degree of commercial success, the end panel utilized in connection therewith still of necessity must be formed from a metal blank having a thickness of approximately 0.013 inches to withstand the desired buckle and rock pressures.

Various proposals have been suggested for reducing the metal thickness of an end panel. One example of such proposal is disclosed in Cospen et al. U.S. Pat. No. 3,843,014. This patent discloses a particular configuration for the countersink portion of an end panel between a peripheral curl and a center flat panel portion. The patentees of this patent indicate that the particular configuration of the end panel will allow a panel to be formed from metal having a thickness on the order of 0.0115 inches. Actual tests were conducted with sample end panels constructed in accordance with the teachings of the Cospen et al. disclosure and it was found that while the container end panel was capable of withstanding the minimum buckle pressures required, the particular configuration resulted in the end being bulged outwardly sufficiently by approximately 30 psi to produce a "rocker" container. Thus, such a proposal has not been accepted as a commercially feasible alternate to the present commercial ends.

Another more recent proposal for utilizing sheet metal stock of less thickness than the standard indicated above has been developed by Aluminum Company of America, Pittsburgh, Pa., which is disclosed in U.S. Pat. No. 4,031,837. This proposal contemplates increasing the depth of the center panel with respect to the lower edge of the outer countersink above the present standard of 0.065 inches for a conventional 209 diameter aluminum beer and beverage end. While test data from the developer of this product indicates that the container is capable of withstanding the minimum required buckle pressures, the particular configuration of the end requires new seamer chucks for double seaming the end panel onto a container body. Such an approach is unrealistic from a commercial standpoint since most packagers will utilize various types of ends from different manufacturers and these ends of necessity must be capable of being double seamed to a container utilizing a standard chuck seamer. For example, a packager may make one run utilizing a certain end manufactured by one company and then shift to a further end manufactured by another company. If different types of chuck seamers are required for the various operations, a substantial amount of time and cost will be involved in converting the seamers to accommodate different ends. This approach also requires that the diameter of the blank used for making the end be increased.

SUMMARY OF THE INVENTION

According to the present invention, a metal container end panel is formed from a metal having a thickness of 0.0120 inches which is capable of withstanding 90 psi minimum buckle pressure and 60 psi minimum rock pressure and the end can be seamed to a container utilizing conventional commercial tooling that is now used for the seaming process.

More specifically, the container end constructed in accordance with the present invention, includes a specifically configured countersink between the peripheral curl and the center substantially flat panel. The countersink includes inner and outer flat walls that are interconnected by a first arcuate portion that has a radius which is less than three times the thickness of the metal and the inner flat wall is integrally joined at its upper end with the center panel through a second arcuate portion that has a radius which is approximately twice the thickness of the metal. The outer flat wall defines an angle of less than five degrees with respect to a plane that extends perpendicular to the center panel and has a length such that the upper edge is located above the lower peripheral edge of the central flat panel portion. Preferably, the inner flat wall has a length sufficient to locate the lower edge of the first arcuate portion about 0.075 or more inches below the lower peripheral edge of the flat central panel portion, and the area above the outer flat wall is inclined outwardly to minimize interference with the chuck seamer. The end also has a second outer flat wall above the upper edge of the first outer flat wall and the outer flat wall defines an angle with a perpendicular plane that is substantially greater than the first angle.

According to one aspect of the invention, the second arcuate portion connecting the inner flat wall to the central panel portion is coined to reduce the thickness thereof, which increases the buckle pressure of the end, while the central panel portion is domed slightly away from the countersink to further increase the buckle pressure of the end.

The apparatus and method for producing the unique end includes upper and lower dies, which are movable relative to each other along a path. The lower die includes a central die member surrounded by inner and outer annular die members, which cooperate with each other to produce an annular recess while the upper die member has an annular punch received into the recess. The three die members of the lower die are adjustable relative to each other and the closed position of the punch is adjustable relative to the three lower die members to accurately control the dimensions of the countersink.

DETAILED DESCRIPTION

Figure 1:
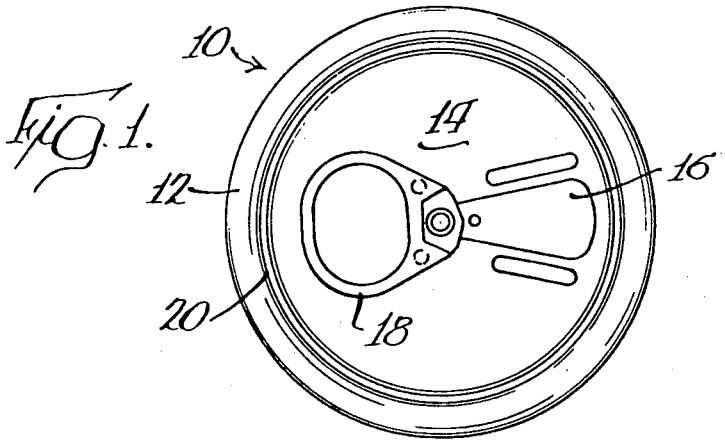
FIG. 1 shows a plan view of a metal container end constructed in accordance with the teachings of the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 of the drawings illustrates a container end, generally designated by reference numeral 10, having a peripheral curl 12 which is adapted to be seamed onto a container body utilizing a conventional double seaming process. Container end 10 has a generally flat central panel portion 14 which has a score 16 produced therein to define a removable section. A tab 18 is connected to removable section 16. As is conventional in ends of this type, container end 10 has a countersink 20 located between peripheral curl 12 and central flat panel portion 14.

The opening means including score 16 and tab 18 are shown for purposes of illustration only and any other type of opening means may be incorporated into the end of the present invention. For example the opening means may be of the "button" or any other "ecology" type end. Also, the end constructed in accordance with this invention can be used on either a two-piece or a three-piece container.

According to the present invention, countersink 20 is specifically configured so that the container end panel may be formed from a flat blank having a thickness on the order of 0.0120 inches or less and having the same diameter as the blanks used for making present ends, while still being capable of resisting buckle pressures of at least 90 psi and rock pressures of at least 60 psi. Furthermore, this can be accomplished with a minimum modification of the existing tool normally utilized for converting an end panel to a finished end.

Figure 3:
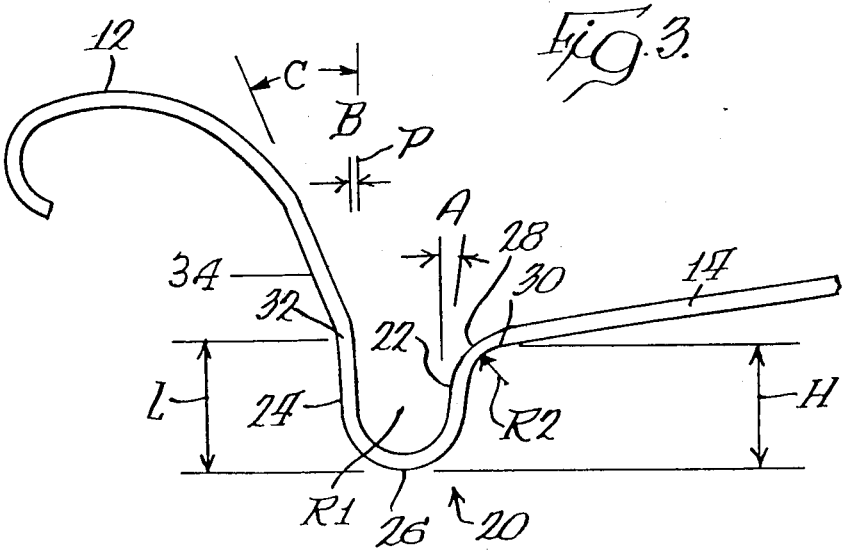
FIG. 3 is an enlarged fragmentary sectional view of the peripheral portion of the container end.

Referring to FIG. 3, the countersink 20 includes an inner wall 22 and an outer wall 24 which are interconnected by an arcuate portion 26. Inner wall 22 is connected to center panel portion 14 through an arcuate portion 28.

According to the present invention, all of the parameters or dimensions of the respective portions which form a countersink 20 are critical and are interrelated to each other to optimize the maximum pressures that the end is capable of withstanding without buckling or rocking. More specifically, inner flat wall 22 has a length that will locate the peripheral edge 30 of central panel portion 14 a dimension H above the lower edge of arcuate portion 26.

It has also been determined that the angle (A) of inner flat wall 22 with respect to a reference plane P, when considered in conjunction with the length of flat wall 22, has a significant effect on the pressure resistance the container can withstand without failure. It has been determined that by having the dimension H at least 0.075 inches with a tolerance in the range of $\pm 0.005$ inches and having a minimum angle A, the buckle and rock pressures are substantially increased, when compared with a present day standard 209 diameter end having the dimension H set at 0.065 inches.

Also, the length of outer flat wall 24 and the angle thereof are critical toward obtaining buckle pressures of more than 90 psi and rock pressures of more than 60 psi utilizing an aluminum blank which has a thickness of 0.012 inches or less. Preferably, this outer straight flat wall portion 24 is of a sufficient length such that the juncture 32 between the upper end of flat wall portion 24 and the lower end of peripheral curl 12 is located at a height of more than 0.080 inches above the lower edge of countersink 20, more specifically, arcuate portion 26. The angle B defined between wall portion 24 and a vertical plane P extending perpendicular to the panel is preferably less than five degrees and in the illustrated embodiment is approximately four degrees.

Stated another way, the length of flat outer wall portion 24 is such that the juncture 32 at the upper end of outer flat wall 24 is located above the peripheral lower edge of flat panel portion 14. However, while this flat portion is preferably longer, the maximum dimension is dictated by the existing seamer tooling so as not to interfere with the double seaming of the end onto the container.

The particular dimensions of the radii R1 and R2 are also important in producing an acceptable end that meets minimum buckle pressure requirements utilizing a stock material having a thickness of 0.0120 inches or less. In the embodiment illustrated, the radius R1 is less than three times the thickness of the aluminum while the radius R2 is preferably approximately twice the thickness of the aluminum metal. In order to further increase the resistance of the end to buckling, the arcuate portion 28 is coined along the radius portion R2 so as to reduce the thickness of the arcuate portion and work harden the metal therein. This work hardening of the metal results in stiffening the arcuate area 28 which increases the resistance to buckling. The central panel portion also preferably has a slight upward dome having a radius R3.

It has also been determined that interference between the conventional chuck seamer (not shown) can be minimized or eliminated by forming a second flat wall portion 34 between wall portion 24 and peripheral curl 12. The second wall portion 34 preferably defines an angle C with respect to plane P which is substantially greater and preferably at least six times greater than angle B.

Figure 2:
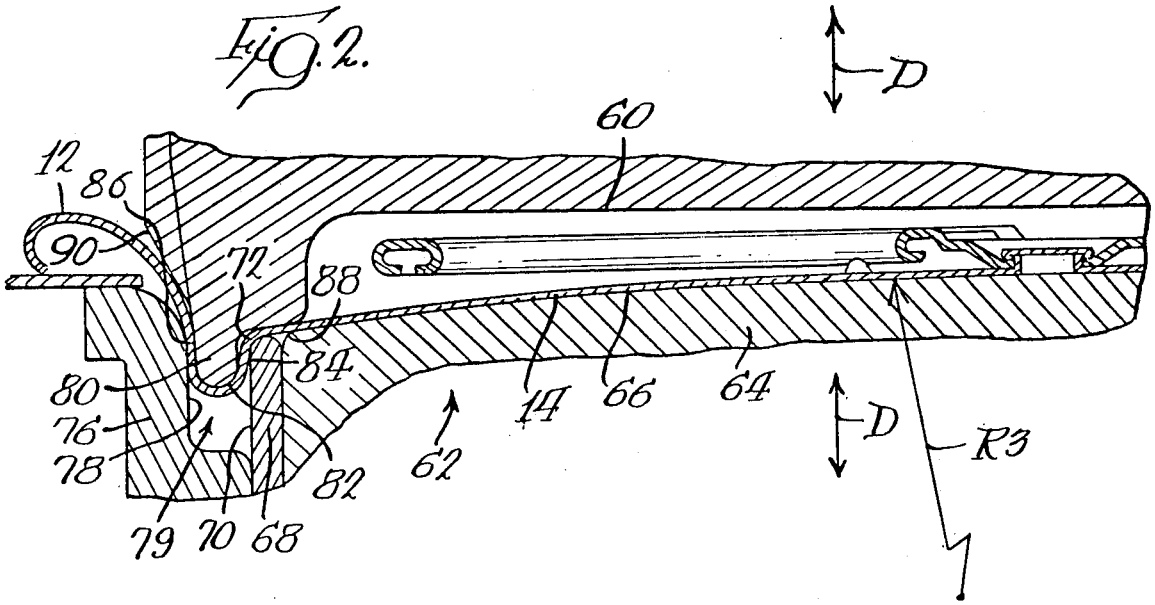
FIG. 2 is a fragmentary sectional view of the tooling utilized for forming the countersink walls.

The apparatus for producing the unique end is disclosed in FIG. 2 and consists of an upper die 60 and a lower die 62 which cooperate with each other to form the countersink of the particular construction described above. A lower die 62 consists of a central portion or member 64 that has a spherical upper surface 66 to produce a slight dome in the central panel portion 14. The lower die 62 also includes an inner die member 68 which has an outer peripheral surface 70 that extends parallel to the plane that extends perpendicular to the end. The upper end of vertical surface 70 has an arcuate portion 72 which has a radius of less than 0.030 inches. Lower die 62 also has an outer die member 76 that has surface or wall 78 which cooperates with surface or wall 70 to define a recess 79 and outer surface 78 of recess 79 defines an angle of less than five degrees with respect to vertical surface 70 or a plane extending perpendicular to the end 10.

Upper die 60 has an annular punch 80 which has a lower arcuate surface 82 which circumscribes an arc of 180 degrees and has flat vertical inner and outer surfaces 84 and 86 at opposite ends of arcuate surface 82. Annular punch 80 is adapted to be received into recess 79 that is defined between surfaces 70 and 78. Upper die 60 also has an inwardly directed generally horizontal surface 88 located above the lower edge of arcuate surface 82 by a predetermined dimension as will be explained later. Upper die 60 also has an outer annular inclined surface 90 which is inclined with respect to a plane extending perpendicular to end 10 by an angle substantially greater than the angle for wall 78 and is at least six times greater thah such angle. Also, the spacing between surfaces 70 and 78 is just slightly greater than twice the radius of arcuate surface 82 and twice the thickness of the metal. The juncture between surfaces 86 and 90 is located above the periphery of inclined generally horizontal surface 88, which is located at least 0.080 or more inches above the lower edge of arcuate portion 82.

Thus, when punch 80 is moved towards lower die 62, trough 20 will be formed with the inner wall 22 being substantially vertical and outer wall 24 also being substantially vertical and the lower edge of arcuate portion 26 is moved away from central panel portion 14. As the upper die bottoms out with respect to lower die 62, the arcuate surface 72 cooperates with inwardly directed inclined surface 88 to coin the arcuate area around the periphery of central flat panel portion 14.

The advantage of making lower die 62 as a three-piece unit will be apparent. One significant advantage is that inner and outer die members 68 and 76 can be moved relative to each other along the path of movement of dies 60 and 62 to accurately position an upper edge of flat outer wall 78 with respect to an upper edge of arcuate surface 72 on the upper end of inner wall 70 of recess 79.

This arrangement allows the manufacturer of ends to accurately control the specific dimensions of countersink 20, particularly the depth thereof with respect to central panel 14. Also, the three die members that define lower die 62 can readily be adjusted to accommodate metal of varying thickness. It will be appreciated that the thickness of a coil of metal specified to have a thickness of 0.0120 inches may vary in thickness ±0.0005 inches. Thus, this variation can readily be accommodated by proper adjustment of die members 64, 68 and 76 with respect to each other along the path of movement of dies 60 and 62, indicated by arrows D in FIG. 2.

In addition, if a slight increase in buckle pressure is desired, with a small sacrifice in rock pressure, the amount of coining of arcuate portion 28 can be increased.

The adjustment of die members 64, 68 and 76 relative to each other is a simple matter which can be accomplished in a short period of time. For example, the die members are normally fixedly secured to a bed of a press through the use of bolts (not shown). For adjusting die members 64, 68 and 72 relative to each other, it is only necessary to select shims (not shown) of a proper thickness and position them between the respective die members and the bed of the press. The closed position of the punch with respect to lower die 2 can be adjusted in the same manner.

Turning now to inner flat wall portion 22 of countersink 20, it is preferable that this wall define a minimum angle with respect to a vertical reference plane. This angle is preferably zero but practical considerations virtually prevent the angle from being zero because it would make it difficult if not impossible to remove the end from the lower die. Therefore, the annular spacing between inner vertical surface 84 of punch 80 and the vertical surface 70 of inner die portion 68 is made as small as possible while still allowing for sufficient clearance for the end to be readily removed from the die. It has been found that by making this space between one and one-third and one and one-half the thickness of the metal stock will produce a minimum angle for vertical wall 22 and still allow the end to be readily removed from the die.

The method aspect of the invention can be best understood from the further description of the apparatus shown in FIG. 2. Upper and lower dies 60 and 62 are aligned with each other for relative movement along a predetermined path so that annular punch 80 is aligned with recess 79 and inclined surface 88 is aligned with inner die portion 68. A sheet of metal material having a thickness of about 0.0120 inches is then inserted between the die elements and the die elements are moved towards each other to force the punch into the recess and produce countersink 20. During this relative movement, a portion of the metal material is forced into engagement with outer surface 78 of recess 79 to produce a first flat wall portion 32 and a second flat wall portion 34 for the outer portion of the countersink or trough. At the same time, the cooperation between die portion 68 and punch 80 produces a second or inner flat wall portion for countersink 20 and an arcuate portion interconnecting the flat wall portion with the central panel portion. By proper selection of the length of annular punch 80, which is preferably more than twice the radius of its lower arcuate surface in conjunction with the relative lengths of flat walls 70 and 76, the peripheral edge 30 of central panel 14 is located below upper edge 32 of annular flat wall 32.

A specific example of the dimensions for producing a 209 diameter end will now be set forth. Radius R1 is set for 0.030 inches while radius R2 has a dimension of 0.025 inches. Outer flat wall portion 24 defines an angle B of approximately four degrees while inner flat wall portion defines an angle A of 10 degrees. The countersink depth H has a dimension of 0.083 inches while the juncture 32 between peripheral curl 12 and flat wall portion 24 is located at 0.092 inches above the lower edge of arcuate portion 26. The surface 66 has a radius of 8 inches so that R3 is 8 inches. It was determined that the doming of the central panel portion removes all excess metal and in fact stretches the metal in the central panel portion.

A blank having a peripheral diameter of approximately 3.250 inches was converted to the dimensions set forth above to produce a 209 diameter finished end. Actual tests of sample ends produced in accordance with these dimensions show that the ends were capable of withstanding a buckle pressure of approximately 96.5 psi and a rock pressure of 70 psi.

By way of a further specific example, several million 209 diameter ends were made by cutting discs having a diameter of 3.252 inches from a 0.012 gauge 5182-H19 aluminum and converting the discs as described above. The finished ends had a radius R1 of approximately 0.030 inches and a radius R2 had a dimension of approximately 0.025 inches. Inner annular flat wall 22 had an angle A of approximately 10 degrees while first outer flat wall portion 24 had an angle B of approximately 4 degrees. The countersink depth H was maintained at about 0.075±0.003 inches while the upper end 32 of the flat wall was located 0.097 inches above the lower edge of first radiused portion 26. The second annular outer wall portion 34 had an angle C of about 25 degrees and the upper end of wall portion 34 merged with arcuate curl 12 while a selected portion of arcuate portion 28 was coined to approximately 0.001 to 0.002 inches reduction. Virtually all random samples tested had a "buckle" pressure of 90 psi or more than a "rock" pressure of more than 60 psi.

The significant advantage of the particular end constructed in accordance with the teachings of the present invention is that conventional conversion tooling, except for one station, can still be utilized for converting a blank end. Normally, such tooling has six stations with the integral rivet for connecting the tab being formed at the first and second stations, the score producing the removable section being produced at the third station, the tab being preliminarily staked by partial deformation of the rivet at the fourth station and firmly staked at the fifth station. The sixth station in present commercial tooling produces the final configuration for the central panel portion, which produces the strengthening effect in this kind of design.

With the end as described above, it is only necessary to revise the tooling in the sixth station to include the punch portion 80, the domed central portion 64 and inner and outer lower die elements 68 and 76. Furthermore, the particular dimensions, specifically the location of the countersink with respect to the remainder of the end is such that conventional seaming tooling can be utilized for double tooling the present end onto a container body. There are several types of seaming tooling that are presently being used by various packagers but all of these are adapted for having the countersink located at a specific location. The existing seaming tooling requires that the diameter of the center portion of the countersink be 2.296 inches for a 209 diameter end and 2.416 inches for a 211 diameter end. The end described above has the diameter of the center portion of the countersink located at the center point for radius R1, and is 2.296 inches, and the inclined wall 34 provides adequate clearance for any conventional chuck seamer. Thus, the fully converted end can readily be double seamed to a container body utilizing commercial equipment that packagers are presently using.

The particular configuration of the countersink wall, and particularly the depth thereof as well as the length of the outer flat wall portion of the countersink allows the manufacturer of ends to reduce the thickness of the stock material from the present thickness of 0.0135 inches to a maximum thickness of 0.0120 and possibly even 0.0115 inches. Such a reduction in metal thickness substantially reduces the overall cost of manufacturing ends.

What is claimed is:

1. A circular, metal container end having a metal thickness of approximately 0.0120 inches and including a peripheral curl and a central panel with a countersink between said curl and central panel extending below said central panel, the improvement of said countersink having inner and outer flat walls interconnected by a first arcuate portion, said first arcuate portion having a radius less than three times the thickness of said metal, said flat inner wall being integral with said central panel through a second arcuate portion having a radius approximately twice the thickness of said metal and said outer flat wall having a length greater than said inner flat wall so that an upper end is located above a peripheral edge of said central panel, and said outer flat wall defining an angle of less than five degrees with respect to a plane extending perpendicular to said central panel, said peripheral curl extending above said central panel so that said container end is capable of resisting at least 90 psi buckle pressure and at least 60 psi rock pressure.

2. A container end as defined in claim 1, in which said first arcuate portion has a radius of 0.030 inches, said second arcuate portion has a radius of 0.025 inches, and a lower edge of said first arcuate portion is located at least 0.075 inches below the peripheral edge of said central panel.

3. A container end as defined in claim 2, in which said second arcuate portion has a thickness less than the metal thickness of said central panel portion.

4. A container end as defined in claim 1, further including a second flat wall portion integral with said upper end of said outer flat wall and said peripheral curl, said second flat wall portion defining an angle several times greater than the angle of said outer flat wall.

5. The container end as claimed in claim 1 further characterized by said inner flat wall defining an angle with respect to said plane of less than approximately ten degrees.

* * * * *